United States Patent [19]

Yokoi

[11] Patent Number: 5,002,097

[45] Date of Patent: Mar. 26, 1991

[54] HARNESS FRAME TO SHEDDING LEVER CONNECTOR

[76] Inventor: Junichi Yokoi, 11-20 Wakae-Honmachi 2-chome, Higashi-Osaka City, Osaka-Fu, Japan

[21] Appl. No.: 512,535

[22] Filed: Apr. 18, 1990

Related U.S. Application Data

[63] Continuation of Ser. No. 377,414, Jul. 10, 1989, abandoned.

[51] Int. Cl.[5] ..... D03C 13/00

[52] U.S. Cl. ..... 139/82; 139/87; 139/88; 384/373; 384/908; 403/43

[58] Field of Search ..... 384/154, 908, 322, 373, 384/398; 74/DIG. 10, 467; 403/43; 139/82, 88, 87; 24/115 R

[56] References Cited

U.S. PATENT DOCUMENTS

| | | | |
|---|---|---|---|
| 1,572,537 | 2/1926 | Joyce | 384/373 |
| 3,589,780 | 6/1971 | Thompson | 384/398 X |
| 3,604,767 | 9/1971 | Decker | 384/398 X |
| 4,733,976 | 3/1988 | Henriksson et al. | 384/322 |
| 4,771,812 | 9/1988 | Yokoi | 139/87 X |

*Primary Examiner*—Andrew M. Falik

*Attorney, Agent, or Firm*—Wenderoth, Lind & Ponack

[57] ABSTRACT

A connector for joining a wire or a second machine element (associated with a harness frame, for example) to a first machine element (a Dobby machine, for example) has a bracket including spaced-apart opposed side plates, a bearing and a wire connecting mechanism. The bearing is unmovably engaged with a mating holding portion connected to the first machine element and includes a body member made from synthetic resin, and which body member defines a shaft hole having a supporting shaft rotatably inserted therethrough, and a lubricant storing recess in the upper portion thereof. A lubricant retaining member is inserted in the recess to keep a lubricant infiltrated in the lubricant retaining member. A bottom surface of the recess is open to a lubricant feeding slot of a small diameter which extends to the inner circumferential surface of the shaft hole of the bearing. On the other hand, the wire connecting mechanism includes three rest members spaced at suitable intervals in the intersecting direction of the opposing direction of both side plates, wire jointing members connected to one end portion of a connecting wire and detachably inserted between every two rest members, anchoring members pivotally engaged therewith so that the anchoring members are disengageably mated with the wire jointing members to prevent the detachment of the wire jointing members from the rest members, and fixing bolts detachably screwed to the anchoring members and the rest members to hold the anchoring members in engagement with the wire jointing members.

3 Claims, 14 Drawing Sheets

HARNESS FRAME TO SHEDDING LEVER CONNECTOR

This application is a continuation of now abondoned application, Ser. No. 07/377,414 filed on July 10, 1989.

BACKGROUND OF THE INVENTION

1. Field of the Invention

The present invention relates to improvements in a connector means disclosed in the U.S. Pat. No. 4,771,812 to the same inventor as this application, such as is used in a weaving machine or the like, wherein a bearing means and/or a wire connecting mechanism is used to join a wire or a machine element to a different machine element.

2. Description of the Prior Art

In, for example, a generally known weaving machine of what is called the negative type, the connecting wires or cables are connected to a harness frame at their one ends, and the other ends of the wires or cables are joined to one end of a bracket of the connector means which is provided with a pair of spaced-apart side plates. The shedding lever of an actuating device, such as the Dobby machine, for the weaving machine is provided with a curved portion for holding a bearing means. On the other hand, the bracket of the connector means has a bearing means interposed between both spaced-apart side plates thereof in the other end. This bearing means is unmovably engaged with and held in the abovementioned curved portion of the shedding lever. Both side plates of the bracket have a supporting shaft means caulked across them at their one ends, and this supporting shaft means is inserted through a shaft hole in the central portion of said bearing means, whereby the bracket is connected to the shedding lever of the Dobby machine.

In the conventional connector means of the foregoing construction, however, no provisions or arrangements are made for satisfactory lubrication between the outer circumferential surface of the supporting shaft means and the inner circumferential surface of the shaft hole of the bearing means. This is a disadvantage of the conventional bearing means used with the shedding lever of the Dobby machine. Therefore, such means have been desired to be proposed.

Moreover, in the conventional connector means, in order to connect each wire extending from the harness frame, to the connector means, an end portion of the wire is inserted into and fixed to a base portion of the connector means. A connecting pin mounted on an end portion of the connector means is received in an engaging notched portion of a pivotal extension of the bracket. However, in this prior art arrangement, the rotational movement of the shedding lever causes the connecting pin to turn within and relative to the engaging notched portion which results in abrasion of the connecting pin which leads to breakage thereof. This also is a disadvantage of the conventional connector means used with the shedding lever of the Dobby machine.

In order to overcome the foregoing disadvantages of the conventional connector means, a variety of proposals have been made such as, for example, the wires are fixed to the bracket by winding the wires directly into the bracket and securing the wires within the bracket. However, these proposals have not met with success, since the connector means becomes complicated in construction, and the bracket and wire assembly must be replaced with a new one if the wires become cut or damaged.

In the first cited U.S. Pat. No. 4,771,812 to the same inventor as this application, an improved connector means was provided in which the foregoing disadvantages and problems of the conventional connector means are removed. The connector means of the present invention is further improved to provide satisfactory long-term lubrication between the outer circumferential surface of the supporting shaft means and the inner circumferential surface of the shaft hole, and also to provide the prevention of early breakage of the joint between the bracket and the connecting wire, easier replacement of the connecting wire, and to eliminate the necessity of replacing the bracket itself with a new one at the time of the wire replacment.

SUMMARY OF THE INVENTION

It is an object of the present invention to provide an improved connector means in which the foregoing disadvantage of the conventional bearing means is overcome.

The foregoing object is fully accomplished by the present invention wherein the following arrangements are made in a bearing means and a wire connecting mechanism both of which form important components of the connector means according to the present invention.

In the present invention, the bearing means includes a shaft hole having a supporting shaft means rotatably inserted therethrough, and is engaged with the holding portion of the shedding lever such that the bearing means does not move with resepct to the shedding lever.

A first arrangement in this bearing means is such that the bearing means is formed with a lubricant storing recess in the upper portion thereof, and the lubricant storing recess has a lubricant retaining member inserted therein to keep a lubricant infiltrated in the lubricant retaining member, while at the same time, the lubricant storing recess is provided with a feeding slot of a small diameter in the bottom surface thereof so that this slot extends to the inner circumferential surface of the shaft hole of the bearing means.

In operation, the bearing means of the present invention in which the forgoing arrangement is provided achieves satisfactory lubrication between the outer circumferential surface of the supporting shaft means and the inner circumferential surface of the shaft hole in the bearing means, because a lubricant is supplied between these both surfaces from the lubricant storing recess of the bearing means, while at the same time, since the lubricant storing recess and the inner circumferential surface of the shaft hole are communicatively connected with each other by means of the lubricant feeding slot of a small diameter, the supply of a lubricant from the lubricant storing recess to the contact surfaces of the supporting shaft means and the shaft hole with each other is gradually feasible over a long period of time, thereby achieving long-term lubrication between the outer circumferential surface of the supporting shaft means and the inner circumferential surface of the shaft hole of the bearing means.

Moreover, in the bearing means arrangement according to the present invention, satisfactory long-term lubrication can also be achieved even if the supporting shaft means moves within and with respect to the shaft hole of the bearing means, because the lubricant storing recess of the bearing means has the lubricant retaining member included therein, in which a lubricant keeps infiltrated to allow the lubricant to be retained in the lubricant storing recess over a long period of time.

A second arrangement is made in the wire connecting mechanism. In this second arrangement, the spaced-apart opposed side plates of the bracket have three rest means secured therebetween at suitable intervals of place in the intersecting direction of the opposing direction of both side plates. Wire jointing means are connected to corresponding portions of the connecting wires, and are detachably inserted between every two rest means in the side plates. Also, the side plates have anchoring means pivotally engaged therebetween so that the anchoring means are disengageably mated with the wire jointing means to prevent the detachment of the wire jointing means from the rest means. In order to hold the anchoring means in engagement with the wire jointing means, and also to press the wire connecting means fixedly against the rest means which are located adjacent the peripheral portions of the side plates, fixing bolts are detachably screwed to the anchoring means and the rest means.

BRIEF DESCRIPTION OF THE DRAWINGS

The present invention will be described with reference to the accompanying drawings, in which.

DETAILED DESCRIPTION OF THE PREFERRED EMBODIMENTS

The first preferred embodiment of the connector means according to the present invention will now be described with reference to FIGS. 1 to 9.

Figure 1:
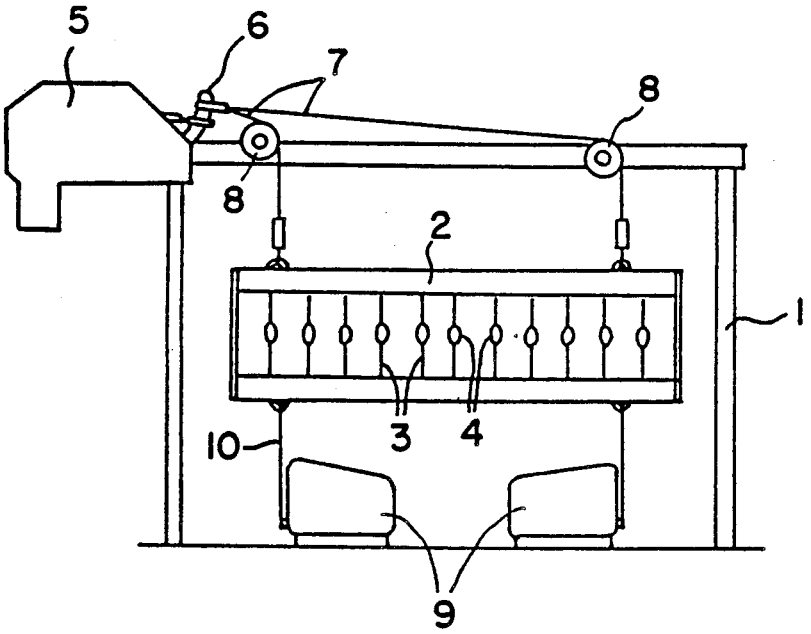
FIG. 1 is a schematic elevational view of the overall arrangement of a weaving machine, in which a connector means according to first, second, third or fourth preferred embodiments of the present invention is selectively used.
Figure 2:
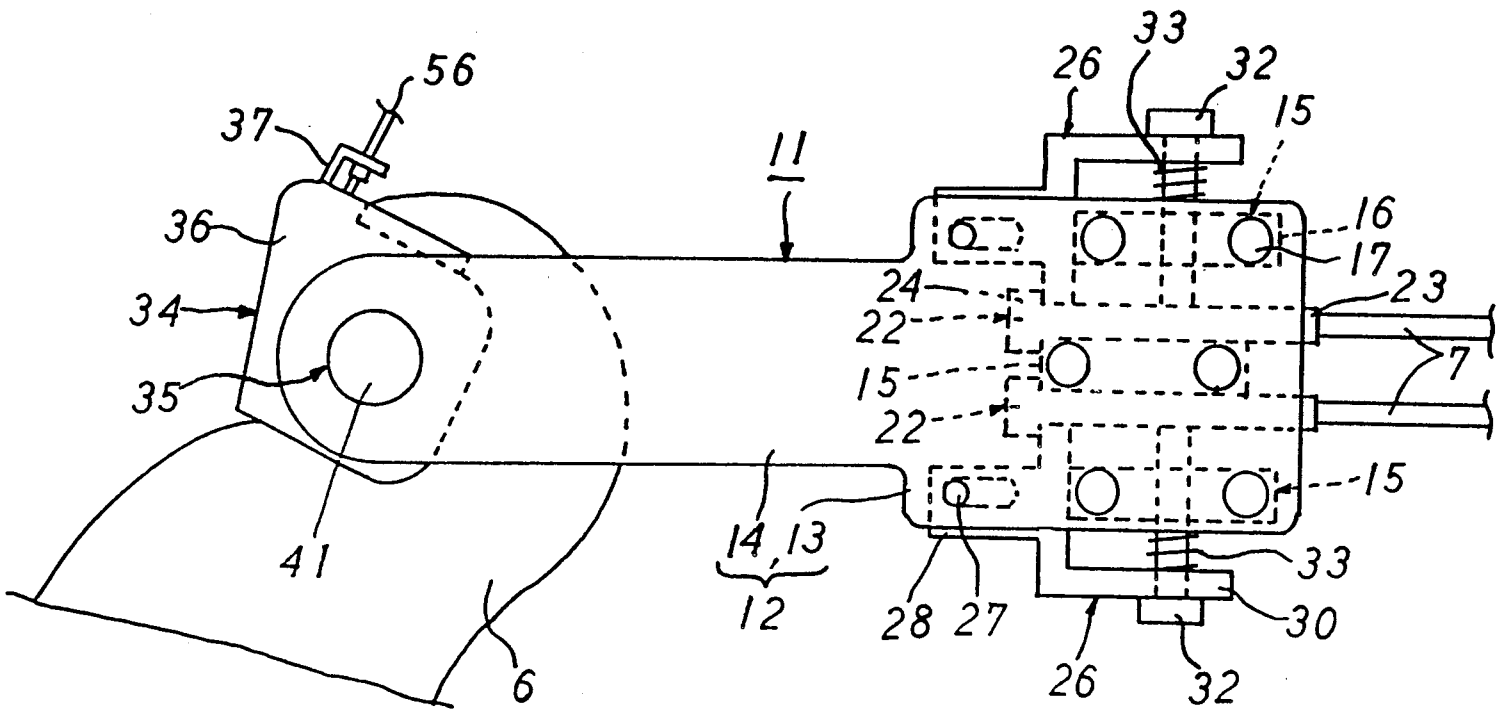
FIG. 2 is an elevational view of a principal part of the connector means between the harness frame and Dobby machine, and this connector means includes a bearing means and a wire connecting mechanism, both of which form components of the connector means according to a first embodiment of the present invention.
Figure 3:
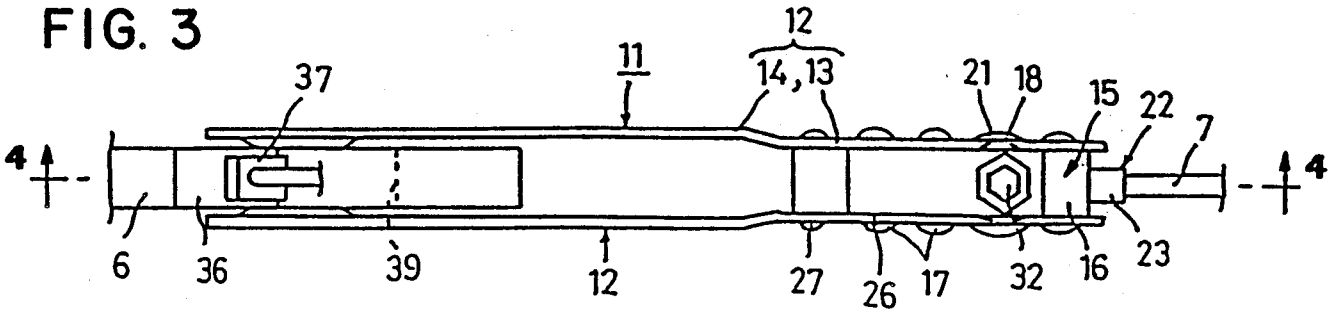
FIG. 3 is a side view of the connector means shown in FIG. 2.
Figure 5:
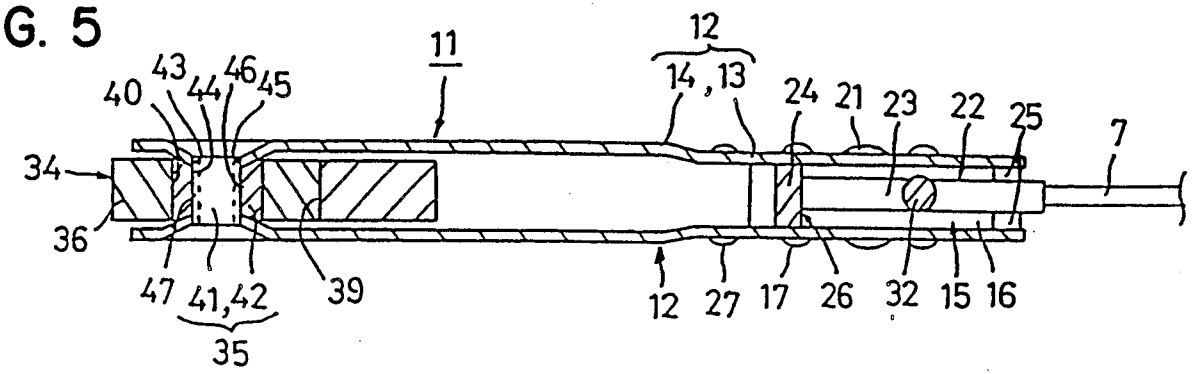
FIG. 5 is a cross-sectional view taken along the line 5—5 of FIG. 4.

FIG. 1 shows a frame 1 of a weaving machine, in which one harness frame 2 is vertically movable. A plurality of such harness frames 2 extend horizontally within the frame 1, and each harness frame 2 has a large number of heddles 3 mounted therein, which are vertically aligned with each other. Each heddle 3 is provided with a warp passing male or eye 4 located centrally thereon. An actuating device constituting a second machine element of the weaving machine is illustrated in the form of a Dobby machine 5 in the embodiments of the present invention. This Dobby machine 5 is mounted on an upper portion of the frame 1 of the weaving machine. Extending from the Dobby machine are a large number of shedding levers 6 which pivot about a horizontal axis extending into the plane of FIG. 1. Each shedding lever 6 is connected with the right-hand side and the left-hand side upper edge portion of the harness frame 2 by means of connecting wires 7. Pulleys 8 are supported for rotation on the upper portion of the frame 1 to guide the connecting wires 7. Located beneath the harness frame 2 on the left-hand side and right-hand side thereof are a pair of pulling means 9 which draw the harness frame 2 downwardly by means of wires 10.

The connection of the wires 7 to the bracket 11 is carried out by the wire connecting mechanism 13 as described hereinafter.

In FIGS. 2 to 5, a bracket 11 which is preferably made of a steel plate is connected to one of the shedding levers 6, and comprises a pair of spaced-apart side plates 12. Each side plate 12 is provided with a wire connecting mechanism 13 having a square shape at one end thereof, and a supporting portion 14 of elongated rectangular shape at its opposite end. Three holding metallic rest means 15 are mounted between the wire connecting mechanisms 13 of both side plates 12 in the longitudinal direction of the side plates such that these rest means 15 are located vertically (in the intersecting direction of the opposed directions of both side plates 12) with suitable spacing between every two rest means 15. The upper and lower two rest means 15 are arranged adjacent the right hand side base of the wire connecting mechanism 13, and the middle rest means 15 between the upper and lower rest means 15 is located near the rectangular supporting portion 14.

Figure 7:
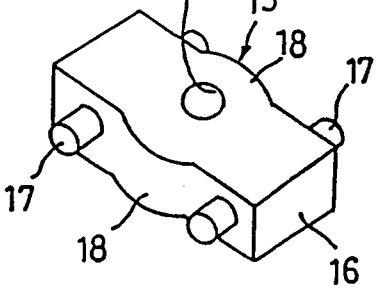
FIG. 7 is a perspective view of a rest means which is used in the wire connecting mechanism of the connector means according to the first, second, third and fourth preferred embodiments of the present invention.

As shown in FIG. 7, each rest means 15 comprises a body 16 of a quadratic prism in shape, two pairs of protrusions 17 horizontally extending from the body 16, and a bulging portion 18 horizontally curvedly extending from the longitudinally middle portion of the body 16.

The longitudinally middle portion of the body 16 is also formed with a vertical female threaded part 19, and this female threaded part 19 is allowed to be great in diameter, because the longitudinally middle portion of the body 16 of the rest means 15 is larger in the horizontally sectional area thereof as a result of the provision of the horizontally bulging portion 18 in the longitudinally middle portion of the body 16.

Figure 6:
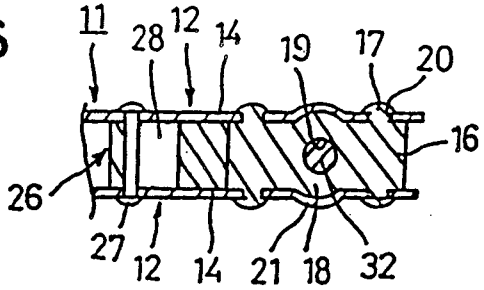
FIG. 6 is a cross-sectional view taken along the line line 6—6 of FIG. 4.

Each protrusion 17 is inserted in an insertion hole 20 of the wire connecting mechanism 13 of each side plate 12, and is caulked to the wire connecting mechanism 13 for the fixation of the protrusion, as best illustrated in FIG. 6.

In the wire connecting mechanism 13 of each side plate 12, a mating portion 21 for mating with the bulging portions 18 of the rest means 15 is also convexedly swelled outside to engage the horizontally bulging portion 18 of the rest means 15 with this mating portion 21. This allows the rest means 15 to be free from any overall curving thereof which can be caused by vertical movement of the longitudinally middle portion thereof.

Metallic wire jointing means 22 are integratedly formed of base side tubular portions 23 and flange portions 24 which are located on the side of the supporting portion 14, and are larger in diameter than the tubular portions 23, and the tubular portion 23 has the connecting wire 7 ends inserted and caulked therein which are joined with the bracket 11. Each wire jointing means 22 is freely detachably inserted between the neighboring rest means 15, and the flange portion 24 of each jointing means 22 is freely detachably engaged with the supporting portion side (the left hand side) end surfaces of the middle rest means 15 and one of the neighboring rest means.

In this embodiment, the tubular portions 23 of the wire jointing means 22 are respectively provided with a pair of projections 25 in their basic ends, and these projections 25 are arranged to come into abutment or close contact with the wire connecting mechanisms 13 of the side plates 12 of the bracket 11 to thereby prevent any great play of each jointing means 22 between the spaced-apart side plates. However, the tubular portions 23 may be free from the projections 25 as the case may be.

A pair of anchoring means 26 vertically located are pivotally mounted on the wire connecting mechanisms 13 of both the side plates 12 by means of supporting stems 27. The anchoring means 26 respectively comprise a base portion 28 pivotally fitted between the wire connecting mechanisms 13 of both the side plates 12 by means of the supporting stems 27, an engaging member 29 protruded from the base portion 28 to the wire jointing means 22, and a bolt inserting portion 30 extending from the base portion 28 to the right hand side base of the wire connecting mechanism along the upper end or the lower end of the wire connecting mechanism.

The engaging members 29 are in detachable engagement with the right hand side end surface of the flange portion 24 of the wire jointing means 22, and cooperate with the left hand side end surface of the middle rest means 15 to prevent the disengagement of the wire jointing means 22 from the wire connecting mechanism 13, which can be caused by swinging of the anchoring means 26. The engaging members 29 may come into or out of contact with the tubular portions 23 of the wire jointing means 22, as the case may be, when said members 29 are in engagement with the flange portion 24.

The bolt inserting portions 30 are provided with bolt holes 31 internally tapped to receive fixing bolts 32, and are located in the upper and lower anchoring means 26 such as to be aligned with the female threaded parts 15 of the upper and lower rest means 15.

The upper and lower fixing bolts 32 in a pair are detachably inserted through the bolt holes 31 of the anchoring means 26 and then the female threaded parts 19 of the upper and lower rest means 15, whereby the engaging members 29 of the anchoring means 26 remains engaged with the right hand side end surface of the flange portions 24 of the wire jointing means 22, while at the same time, the tubular portions 23 of the wire jointing means 22 are fixedly pressed against the middle rest means 15.

The fixing bolts 32 are wound with coiled type compression springs 32 on their outer surfaces between the bolt inserting portions 30 of the anchoring means 26 and the rest means 15 as opposed to said inserting portions 30, to thereby prevent any play of the anchoring means 26.

The wire connecting mechanism 13 can be also arranged differently from the foregoing first preferred embodiment of the present invention. A different arrangement of the wire connecting mechanism 13 is now described with reference to FIG. 8 which shows a second preferred embodiment of the present invention.

Figure 8:
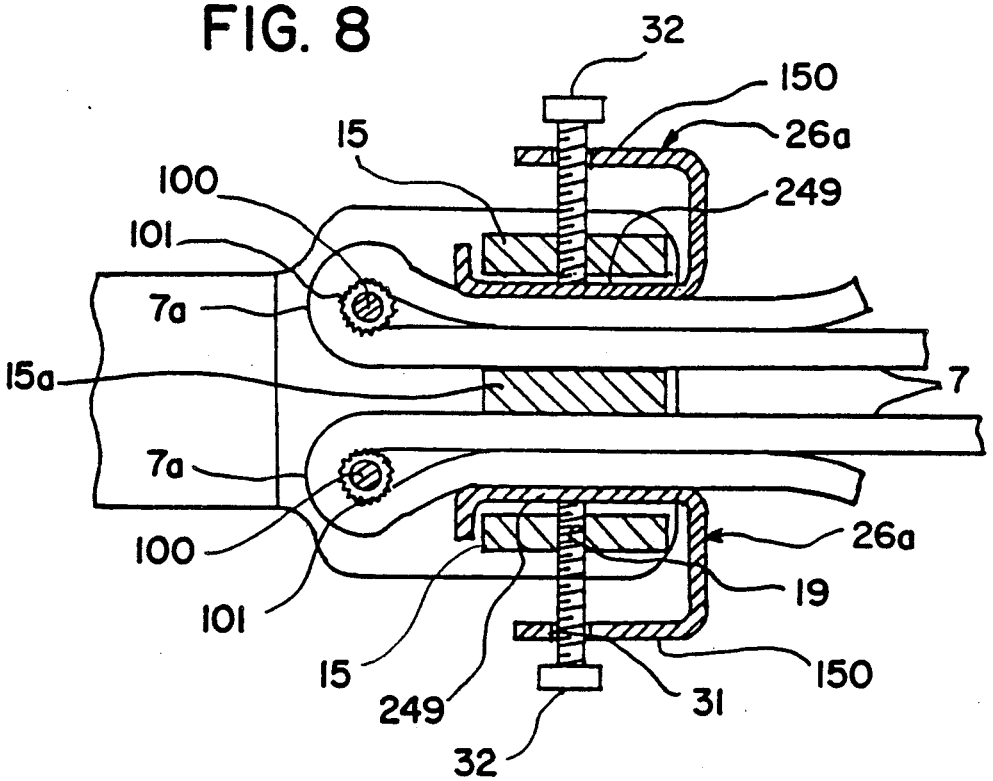
FIG. 8 is a cross-sectional view of a connector means according to a second preferred embodiment of the present invention.

In FIG. 8, the spaced-apart side plates 12 have the three rest means 15 inserted therebetween at suitable intervals of place. Linear wire pressing members 249 and an L-shaped other members are integrally formed into a single unit as anchoring means 26*a*. The wire pressing members 249 are respectively interposed between the middle rest means 15 and the other rest means 15. The U-shaped anchoring means 26*a* are provided with bolt holes 31, and the bolt holes 31 have fixing bolts 32 inserted through them to position the wire pressing members 249 in place.

Each wire 7 is folded down at the bent portion 7*a* thereof, and is inserted between the middle rest means 15a and each wire pressing member 249. The bent portion 7a of the wire 7 is wound around a ringed member 101 which is slipped onto each uniting rivet 100. This ring member 101 is provided with a knurled surface on the outer circumferential surface thereof to prevent the slipping detachment of the wire 7 therefrom.

The insertion of the fixing bolts 32 into the rest means 15 allows each wire 7 to be pressed against the middle rest means 15a, whereby the wire 7 is fixed. In this case, reaction force of the wire 7 acts upon the middle rest means 15a. This reactive force acts along the axis of the fixing bolt. However, in the position at which the reactive force acts, the other rest means 15 is connected to the side plates 12 through the bulging portion 18 thereof so that this rest means can not be moved in the direction in which the reactive force acts. For this reason, the rest means 15 is free from any deformation thereof which can be caused by the reactive force acting upon the fixing bolt, and firm fixation of the wire can be achieved.

The supporting portions 14 of both the side plates 12 in the bracket 11 are arranged to interpose the end portion of the shedding lever 6 therebetween, and a bearing means 34 is rotatably attached to bracket 11 between the end portions of these supporting portions 14 by means of a supporting shaft means 35.

The bearing means 34 comprises a Nylon (TM of Dupont & Co. for a polymer with the recurring amide group CONH) body member 36, a metallic covering member 37 and a lubricant retaining member 38, and may include any other necessary elements as the case may be. The body member 36 may be alternatively made from a synthetic fiber other than Nylon.

In addition, the end portion of the shedding lever 6 is provided with a portion 39 which is formed in a shape which corresponds to the configuration of the right hand side major part of the bearing means 34 to hold the bearing means, whereby the shedding lever constitutes holding means that fixes bearing means 34 to the second machine element (Dobby machine). The Nylon body member 36 of the bearing means 34 according to the first embodiment of the present invention is formed in a substantially square-shaped configuration, and is detachably yet unswingably engaged with this bearing-body holding portion 39 of the shedding lever 6 as a whole excepting for the left hand side portion thereof.

The Nylon body member 36 of the bearing means 34 is formed with a shaft hole 40 centrally thereon which has a supporting shaft means 35 rotatably inserted therethrough. The supporting shaft means 35 comprises in combination an inner shaft element 41 and an outer shaft element 42. The inner shaft element 41 is made of metal, and the outer shaft element 42 of ceramics or metal.

The metallic inner shaft element 41 is adhered at both ends thereof to the supporting portions 14 of both the side plates 12 of the bracket 11 and to the outer shaft element 42. The shaft hole 43 of the supporting portion 14 and that 44 of the outer shaft element 42 are respectively formed with diametrically opposed axially extending grooves 45, 46, and these grooves 45, 46 receive projections 47 of the inner shaft element 41 to thereby prevent rotation of the inner shaft element 41 relative to the supporting portion 14 and the outer shaft element 42. As a result, wear or abrasion of the inner shaft element 41 which can be caused by rotation thereof can be avoided.

The upper portion of the Nylon body member 36 is provided with a lubricant storing recess 48 of an elongated shape. This recess 48 may be slightly tapered in both the longitudinally extending inner surfaces thereof, while at the same time, the recess 48 is formed with wall portions which jut out upwardly from the front side, rear side and left hand side thereof so that these jutting wall portions 49 cover the recess. Only this arrangement even achieves the prevention of outward lubricant splashing from the lubricant storing recess 48 to considerable extent.

Moreover, the lubricant storing recess 48 is provided with a lubricant feeding slot 50 at one end of the bottom surface thereof. This slot 50 is smaller in diameter than the width of the lubricant storing recess 48, and is arranged to extend to the inner circumferential surface of the shaft hole 40 so as to constitute a lubricant feeding guide fluidly communicating lubricant storing recess 48 with shaft hole 40.

Figure 4:
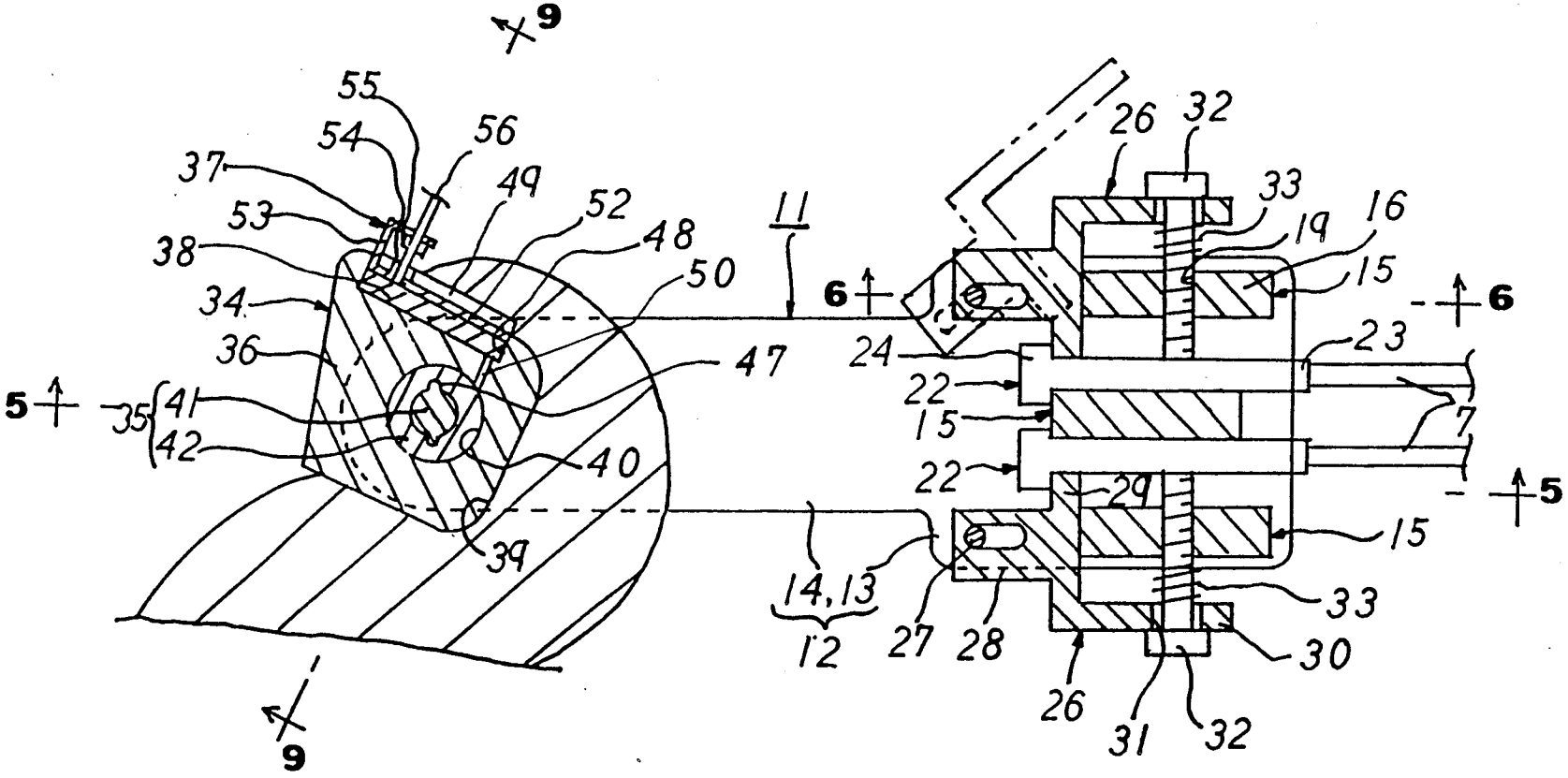
FIG. 4 is a cross-sectional view taken along the line 4—4 of FIG. 3.
Figure 9:
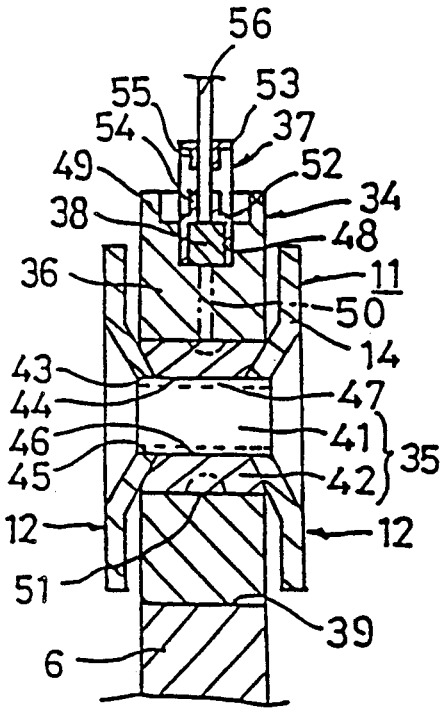
FIG. 9 is a cross-sectional view taken along the line 9—9 of FIG. 4.

In the forming process of the Nylon body member 36 of the bearing means, the lubricant feeding slot 50 is not simultaneously made with the other elements such as the shaft hole 40, the lubricant storing recess and so forth, and is drilled as illustrated in FIGS. 4 and 9 after the formation of the Nylon body member has been completed.

The outside shaft 42 may be provided with a circumferentially extending lubrication groove 51 on the outer circumferential surface thereof, and the lubrication groove 51 may be communicatively connected with the lubricant feeding slot 50, to thereby achieve a reduction in wear or abrasion between this outer circumferential surface on the outside shaft 42 and the inner circumferential surface of the Nylon body member 36 which are in contact with each other.

Figure 10:
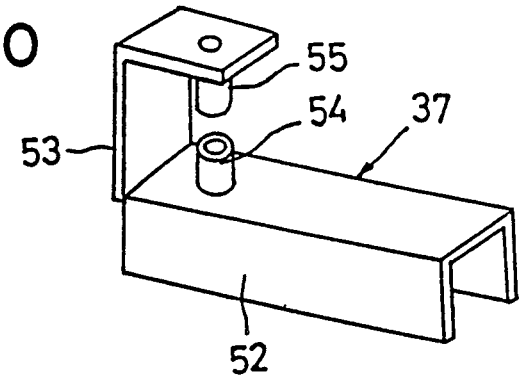
FIG. 10 is a perspective view of a covering member which is applied to the bearing means of the connector means according to the first and sixth preferred embodiments of the present invention.

As shown in FIG. 10, the covering member 37 comprises a reversely U-shaped portion 52 which will be be inserted into the lubricating storing recess 48, an invertedly L-shaped rising portion 53 which protrudes from the left hand side end portion of the reversely U-shaped portion 52, and is to be located leftward of the shedding lever 6, and hose guiding tubular portions 54, 55 which are respectively formed on the reversely U-shaped portion 52 and the rightward extending bent portion of the invertedly L-shaped rising portion 53 so that such portions 54, 55 are vertically opposed.

The foregoing tubular portions 54, 55 have a lubricant feeding hose 56 detachably inserted therethrough to supply a lubricant to the inside of the reversely U-shaped portion 52.

The reversely U-shaped portion 52 of the covering member 37 is provided with the lubricant retaining member 38 therein to keep a lubricant infiltrated in the lubricant retaining member 38. A sponge, cotton wool or the like can be employed as this member 38.

In operation, in the foregoing arrangement according to the first embodiment of the present invention, each harness frame 2 is drawn downwardly by a spring force of the pulling means 9, and if any desired one of the shedding levers 6 of the actuating device 5 is leftward in FIG. 1, the harness frame 2 which is attached to the particular shedding lever 6 is lifted by means of the bearing means 34, the bracket 11, the wire jointing means 22 and the wire 7. As a result, the warps passing through the males or eyes 4 of the heddles 3 of the harness frame 2 are also lifted, and openings are made between such warps and the other warps, whereby wefts are inserted through the openings thus formed.

In this case, since a lubricant is supplied between the inner circumferential surface of the shaft hole 40 of the bearing body 34 and the outer circumferential surface of the outer shaft element 42 of the supporting shaft means 35 from the lubricant storing recess 48 of the bearing means 34, these both surfaces of the shaft hole 40 and the outer shaft element 42 which are mated with each other can be satisfactorily lubricated. Moreover, this satisfactory lubrication is feasible over a long period of time, because the use of the lubricant feeding slot 50 for the comunicative connection between the lubricant storing recess 48 and the inner circumferential surface of the shaft hole 40 achieves gradual and long-term feeding of the lubricant to the mating surfaces between the shaft hole 40 and the outer shaft element 42.

Also, the provision of the lubricant retaining member in the lubricant storing recess 48 is of additional great service to ensure satisfactory long-term lubrication between the inner circumferential surface of the shaft hole 40 of the bearing means 34 and the outer circumferential surface of the outer shaft element 42 of the supporting shaft means 35, because a lubricant can be retained in the lubricant storing recess 48 over a long period of time even if a swinging motion of the shedding lever 6 moves the bearing means.

Moreover, in the first embodiment of the present invention, the tubular portions 54, 55 of the covering member inserted in the lubricant storing recess 48 have the lubricant feeding hose 56 inserted therethrough, and this hose 56 is then communicatively connected to the inside of the reversely U-shaped portion 52 of the covering member 37, as described in the foregoing. Therefore, if the lubricant retaining member 38 runs short of a lubricant infiltrated therein, the lubricant retaining member 38 can easily be replenished with a lubricant through the lubricant feeding hose 56.

In the first embodiment of the present invention, although the lubricant storing recess 48 includes the covering member 37 therein to make provisions for feeding the lubricant retaining member with a lubricant, the lubricant storing recess may be unprovided with the covering member 37, and may be arranged to be directly supplied with a lubricant in the internal lubricant retaining member 38 thereof.

On the other hand, the connector of the present invention offers the easy replacement of the wires 7 without necessitating a simultaneous exchange of the bracket 11. That is to say, if the wires 7 are damaged, the fixing bolts 32 are loosened, and are removed from the female threaded part 19 of the rest meanss 15. As shown in an imaginary line of FIG. 4, the anchoring means 26 are then turned to thereby release the engagement of the engaging member 29 thereof with the flange portions 24 of the wire jointing means 22. The anchoring means 26 are subsequently turned, and if the distance between the engaging member 29 and the middle rest means 15 is greater than the vertical size of the flange portion 24, the wire jointing means 22 is extracted from the neighboring rest means 15.

Thereafter, a new wire 7 is connected to the wire jointing means 22, and the wire jointing means 22 is inserted between the neighboring rest means 15. The wire jointing means 22 is then engaged in the flange portion 24 thereof with the supporting portion side (the left hand side) end surface of the middle rest means 15.

Next, the fixing bolt 32 is inserted through the bolt hole 31 of the anchoring means 26, and is screwed into the female threaded part 19 of the rest means 15 to thereby engage the engaging member 29 of the anchoring means 29 with the basic end surface (the right hand side end surface) of the flange portion 24 of the wire jointing means 22, while at the same time, the tubular portion 23 of the wire jointing means 22 is pressed against the middle rest means 15.

As is apparent from the foregoing description, in the connector of the present invention, the wire 7 can easily be replaced with a new one, and at the same time, the replacement of the wire does not necessitate a simultaneous exchange of the bracket itself.

Figure 11:
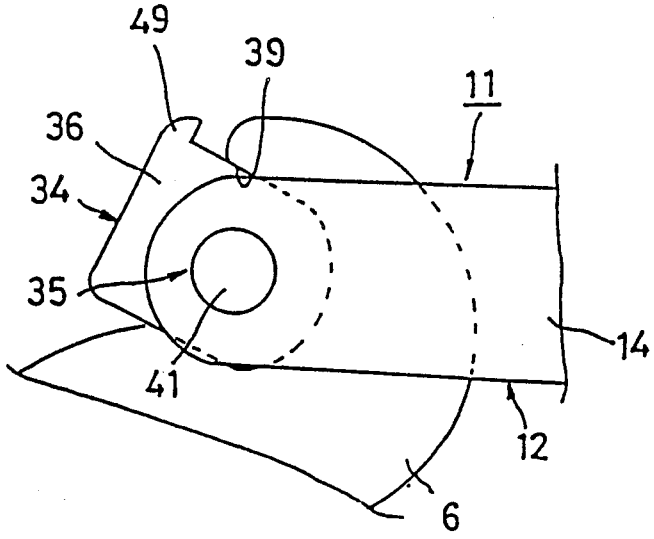
FIG. 11 is an elevational view of the bearing means of the connector means according to the third preferred embodiment of the present. invention.
Figure 12:
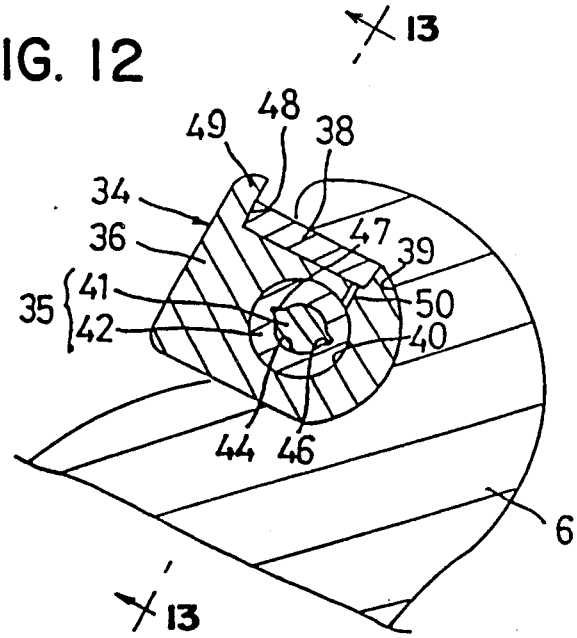
FIG. 12 is a cross-sectional view of the bearing means of FIG. 11.
Figure 13:
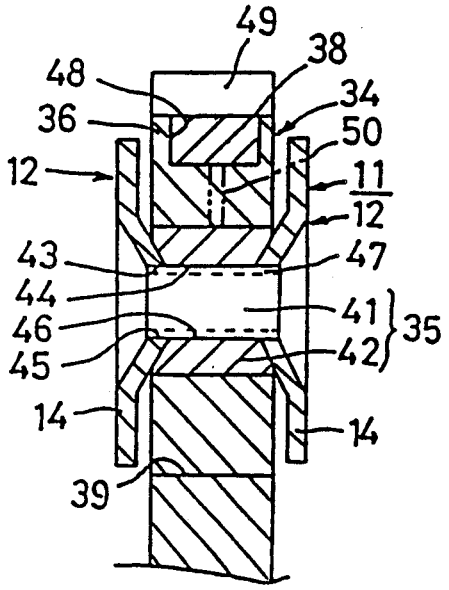
FIG. 13 is a cross-sectional view taken along the line 13—13 of FIG. 12.

FIGS. 11 to 13 show a third preferred embodiment of the present invention wherein the wall portion 49 preventing a splash of a lubricant from the lubricant storing recess 48 is only formed on the left of the lurbicant storing recess 48. In the second embodiment, the lubricant storing recess 48 is not provided with the covering member, and the feeding of a lubricant into the lubricant storing recess 48 is carried out in a manual way.

Figure 14:
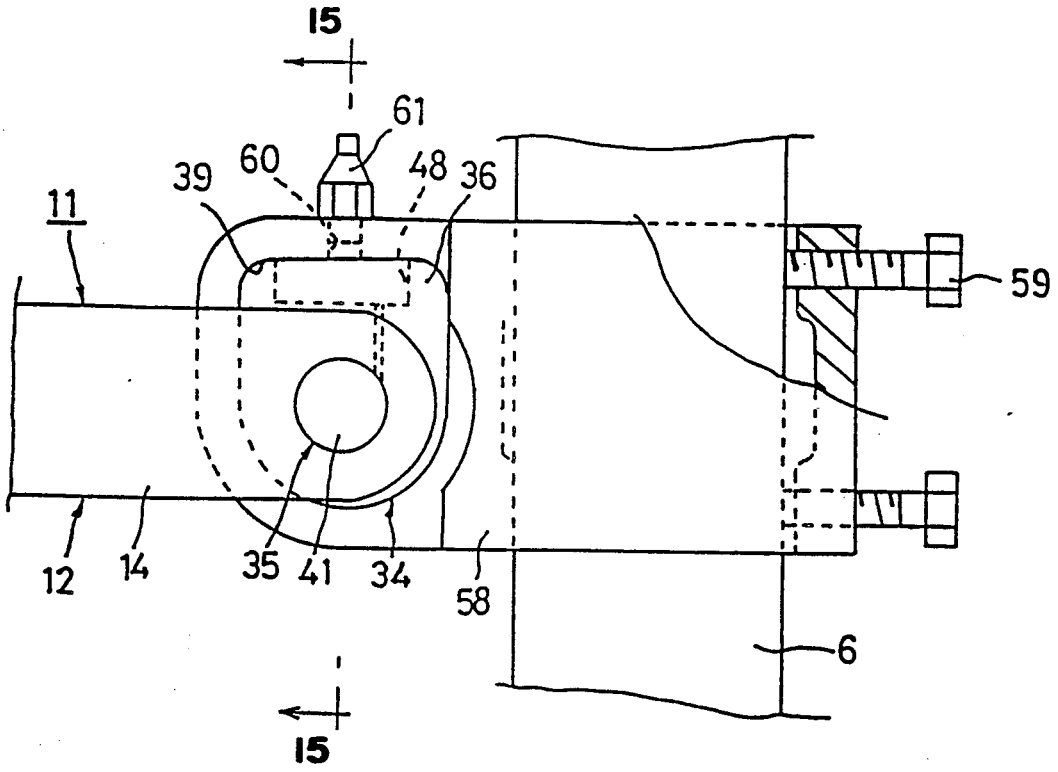
FIG. 14 is an elevational view of the bearing means of the connector means according to the fourth preferred embodiment of the present invention.
Figure 15:
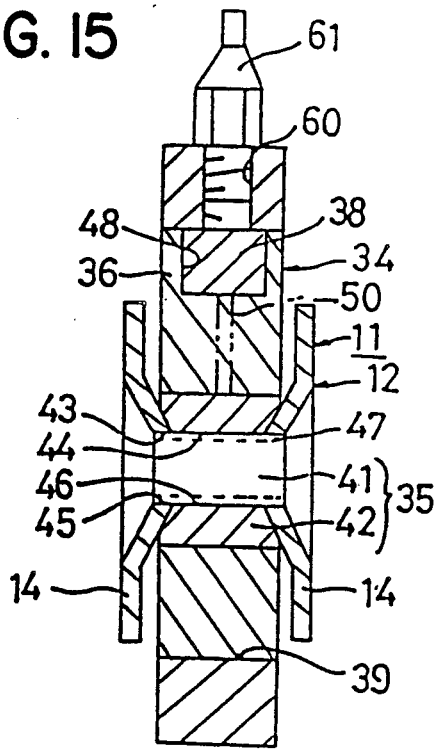
FIG. 15 is a cross-sectional view taken along the line 15—15 of FIG. 14.

FIGS. 14 and 15 illustrate a fourth preferred embodiment of the present invention wherein an attachment member 58 constituting holding means has the shedding lever 6 inserted at one end portion thereof, and bolt means 59 are used to press the shedding lever fixedly against the attachment member 58.

In FIGS. 14 and 15, a holding portion 39 illustrated in the form of an opening is formed at the other end portion of the attachment member 58 to receive in the holding portion the bearing means 34 which is circularly shaped in the lower end portion thereof. This bearing means 34 has the bracket 11 pivotally connected therewith through the supporting shaft means 35.

The attachment member 58 has a lubricant feeding passage 60 vertically formed through the upper end portion thereof at the end portion thereof in which the holding portion 39 is provided for the bearing means, and the lubricant feeding passage 60 is communicatively connected with the lubricant storing recess 48 of the bearing means 34. Moreover, the passage 60 has a grease nipple 61 screwed therein.

Figure 18:
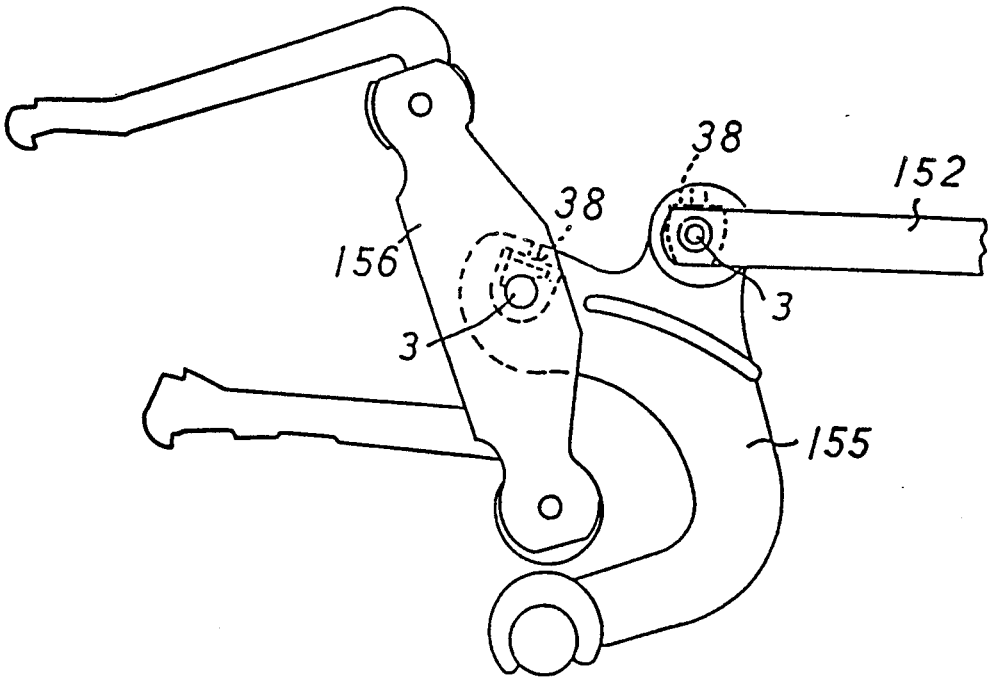
FIG. 18 illustrates that only the bearing means of the connector means according to the first, third or fourth preferred embodiment of the present invention is applied to actuating levers of the actuating device in the weaving machine shown in FIG. 16.
Figure 16:
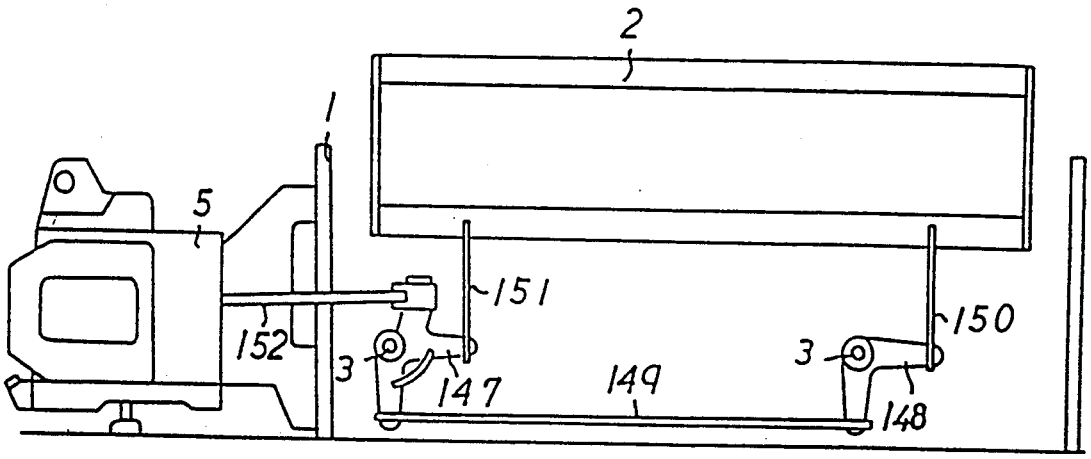
FIG. 16 is a schematic elevational view of the overall arrangement of a weaving machine of what is called the positive type, in which the connector means according to the fifth preferred embodiments of the present invention is used.
Figure 17:
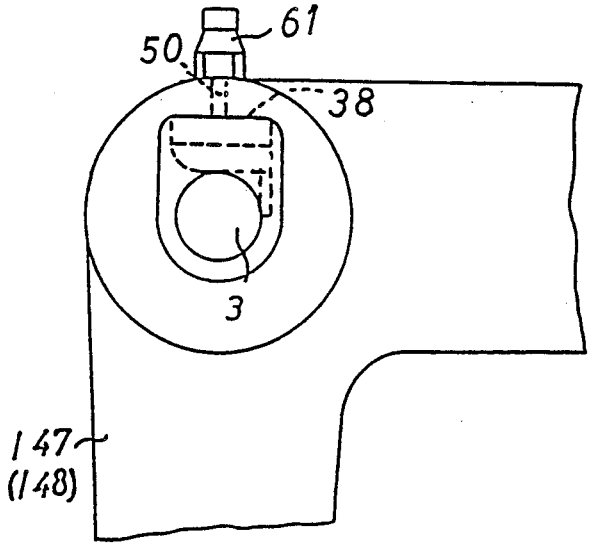
FIG. 17 shows that only the bearing means of the connector means according to the first, third or fourth preferred embodiment of the present invention is applied to links of the weaving machine illustrated in FIG. 16.

In FIGS. 16 to 18 which show a fifth embodiment of the present invention, the bearing means 34 of the connector means according to the present invention is applied to L-shaped links and actuating levers of a weaving machine illustrated in FIG. 16 which differs in construction from the weaving machine described and shown with reference to the foregoing first, second, third and fourth preferred embodiments of the present invention.

In the weaving machine shown in FIG. 16, the machine frame 1 has the harness frame 2 supported therein such that the harness frame can be vertically moved. Moreover, the machine frame 1 is provided with the actuating device (first machine element) 5 on the outside thereof. Also, the machine frame 1 is fitted with a pair of right-hand side and left-hand side L-shaped links 147 and 148 such that these links can be rotated about shaft means of bearing means 34. Both links 147, 148 are connected in their lower ends with each other by means of a linking rod 149. The right-hand side link 148 is joined with the harness frame 2 by means of a linking rod 150, (first machine element) and the left-hand side link 141 is connected with the harness frame 2 by using a linking rod 151 (first machine element), and with the actuating device 5 by means of a linking rod 152.

FIG. 17 shows that the bearing means 34 which is an important component of the connector means according to the present invention is applied to each L-shaped link.

Also, in FIG. 18, the bearing means 34 are used in the foregoing actuating levers 155, 156 within the actuating device of the weaving machine illustrated in FIG. 16.

Figure 19:
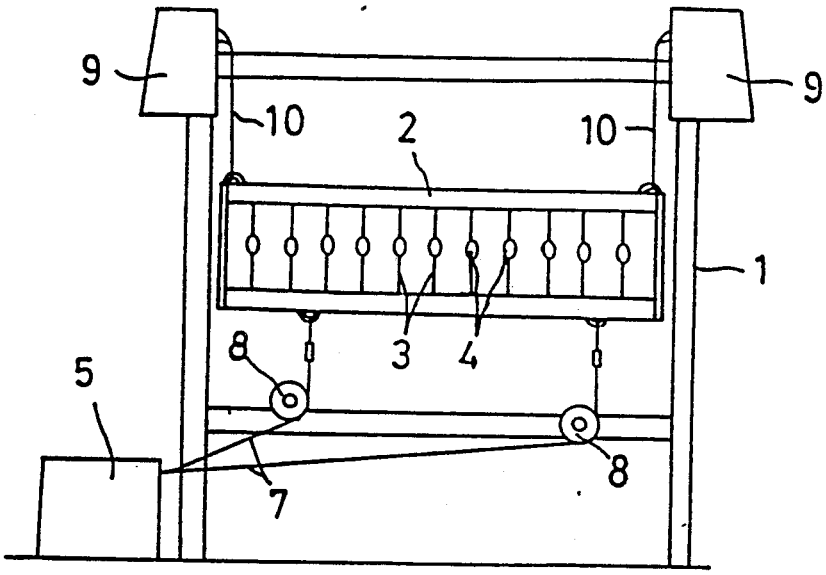
FIG. 19 is a schematic elevational view of the overall arrangement of a different weaving machine of what is called the negative type, in which the harness frame is drawn downwardly by using a cam type actuating device, and is lifted by means of a pair of pulling means 9 located at the upper portion of the machine frame.
Figure 23:
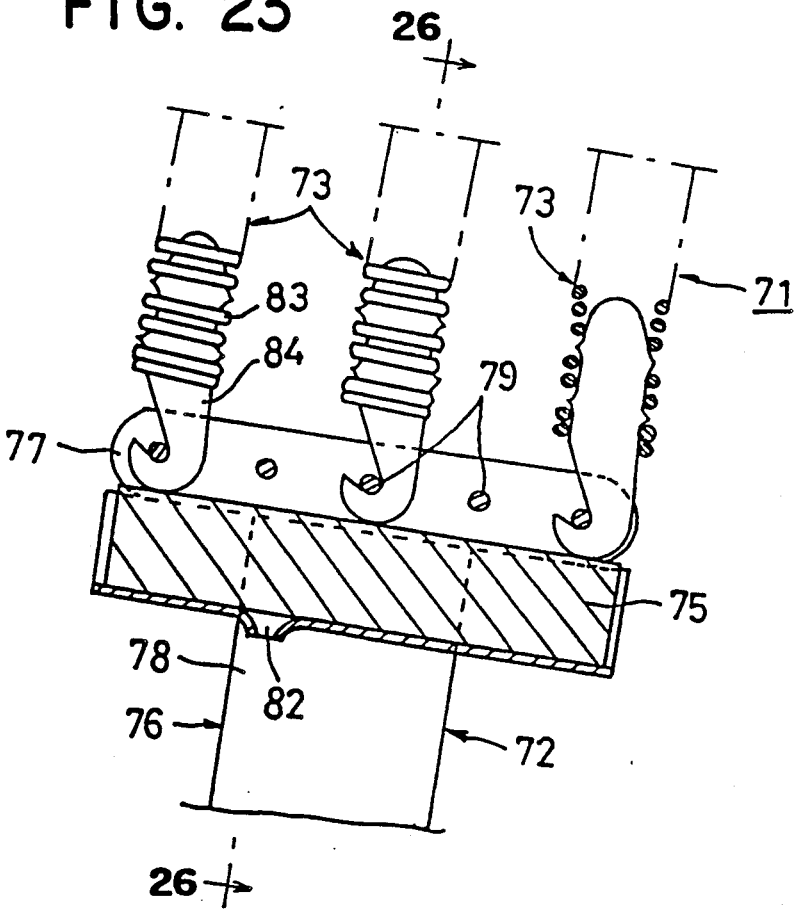
FIGS. 22 and 23 are cross-sectional views respectively taken along the line 22—22 and the line 23—23 of FIG. 21.

FIGS. 19 to 26 show a sixth preferred embodiment of the present invention. In FIG. 19, the weaving machine is arranged differently from that illustrated in FIG. 1. That is to say, the actuating device 5 located on the lower side of the weaving machine includes a cam mechanism, and is arranged to lower the harness frame 2. Also, the pulling means 9 are located on opposite sides of the upper portion of the weaving machine frame 1, and are designed to lift the harness frame 2 vertically.

The pulling means 9 are now described in detail with reference to FIG. 20. For the convenience of explanation, the left-hand side and the right hand side of FIG. 19 are respectively considered to be the outside and the inside of the pulling means 9.

A housing 63 chiefly comprises a pair of front and rear side plates 64, and a connecting member 65 which joins the lower outside end portions of both the side plates 64. The connecting member 65 is provided with a large number of outward projections 66 which are horizontally aligned with each other. Each projection 66 is notched to form a U-shaped holding portion 39 which opens outwardly to receive the bearing means therein.

The housing 63 is also fitted with a large number of drawing levers 67 between both the side plates 64 thereof such that the drawing levers 67 are horizontally aligned with each other. The drawing levers 67 are pivotally supported by means of supporting shaft means 68. The inside end portion of each drawing lever 67 is interlockingly connected with the corresponding side portion of the harness frame 2 through the wire 10. Also, the outside end portion of each drawing lever 67 is provided with a U-shaped holding portion 39 which upwardly opens so that the bearing means is engaged therewith. The turning motion of the drawing lever 67 is brought to a stop by means of stopper means 69, 70 which are provided so as to be bridged between both the side plates 64 of the housing 63.

A plurality of traction mechanisms 71 are respectively elastically interposed between the projection 66 of each connecting member 65 and the outside end portion of each drawing lever 67, and respectively comprise a pair of upper and lower T-shaped brackets, resilient members 73, and upper and lower lubricant retaining members 74, 75.

Each bracket 72 comprises a pair of spaced-apart side plates 76, and each side plate 76 includes a transversely extending catching portion 77 at the basic end portion thereof, and a vertically extending supporting portion 78 at the middle portion thereof, as shown in FIGS. 20, 21, 22 and 25.

Five engaging pins 79 are bridged between the catching portions 77 of both the side plates 76 such that these pins 79 are aligned with each other.

In the upper bracket 72, lubricant storing plates 80 of a substantially trapezoidal shape are secured within the catching portion 77 side supporting portions 78 of both side plates 76, and the lubricant retaining member 74 is provided between the lubricant storing plates 80 to keep a lubricant infiltrated therein.

On the other hand, in the lower bracket 72, a recess type lubricant storing member 81 is fixed within the catching portion 77 side supporting portions 78 of both side plates 76, and this lubricant storing member 81 is provided with an aperture 82 in the bottom surface thereof adjacent the outside thereof so that the aperture 82 opens directly over the bearing means 34, as illustrated in FIG. 19. This lubricant storing member 82 has the lubricant retaining member 75 also inserted therein.

In each traction mechanism 71, the resilient members 73 are three in a total of number, and are hooked in the outside and middle engaging pins 79 of the upper and lower brackets so that the resilient members 73 are interposed between both brackets.

The resilient members 73 respectively comprises a coil spring 83 and hook means 84 attached to both end portions of the coil spring 83. The hook means 84 are detachably engaged with the engaging pins 79, and also, are in contact with the lubricant retaining members 74, 75.

The protrusions 66 of the connecting means 65 and the holding portions 39 of the drawing levers 67 respectively have the bearing means 34 unturnably engaged with them. In each bracket 72, the supporting portions 78 of both side plates 76 have the bearing means 34 rotatably connected to their end portions by means of the supporting shaft means 35.

The Nylon body member 36 of the bearing means 34 is formed with the lubricant storing recess 48. In the forming process of the Nylon body member 36, this recess is provided with three recesses 85 in the bottom portion thereof, and if the Nylon body member 36 has been completely formed, a suitable one of these recesses, such as the outside one is drilled in the case of the upper bearing means 34, to thereby form the lubricant feeding slot 50.

Figure 24:
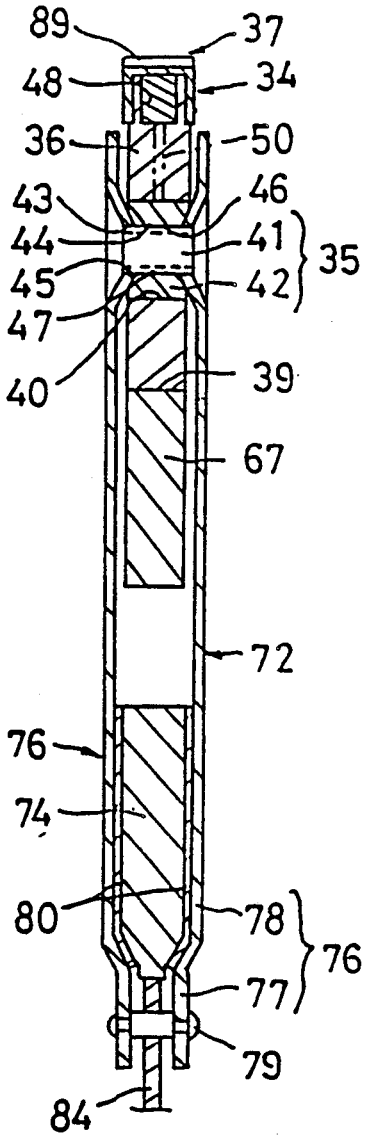
FIG. 24 and 25 are cross-sectional views respectively taken along the line 24—24 and the line 25—25 of FIG. 22.
Figure 26:
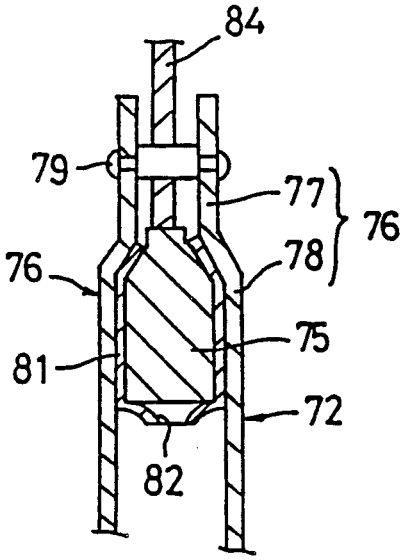
FIG. 26 is a cross-sectional view taken along the line 26—26 of FIG. 23.
Figure 25:
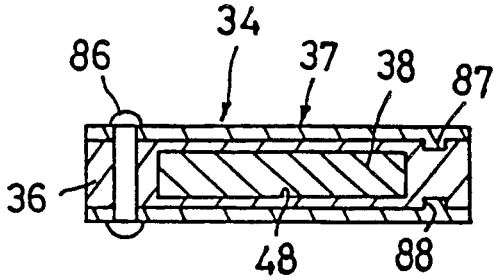

As illustrated in FIG. 24, the covering member 37 is in a reversely U-shaped configuration, and is attached to the lubricant storing recess of the bearing means 34 such that this recess is covered by means of the covering member. The covering member 37 is pivotally supported at one end portion thereof by means of the supporting shaft 86, whereby the lubricant storing recess 48 can be freely opened or closed, while at the same time, the covering member 37 is disengageably engaged with the engaging recess 88 of the Nylon body member 36 of the bearing means 34 in both side internal protrusions 87 of the other end portion thereof, to thereby lock the covering means 37 in the covering state thereof.

The covering member 37 is formed with a raised portion 89 adjacent the foregoing other end portion thereof by raising the top plate portion thereof slightly. This arrangement allows the closed covering member 37 to be easily opened by inserting a screw driver or the like between the raised portion 89 and the Nylon body member.

In the upper bearing means 34, the covering member 37 has the lubricant feeding hose 56 connected to the top plate portion thereof.

In operation, according to the fourth embodiment of the present invention in which the preceding arrangement is made, the harness frames are lowered by means of the resilient members 73 of the pulling means 9 through the drawing levers 67 and the wires 10.

Figure 20:
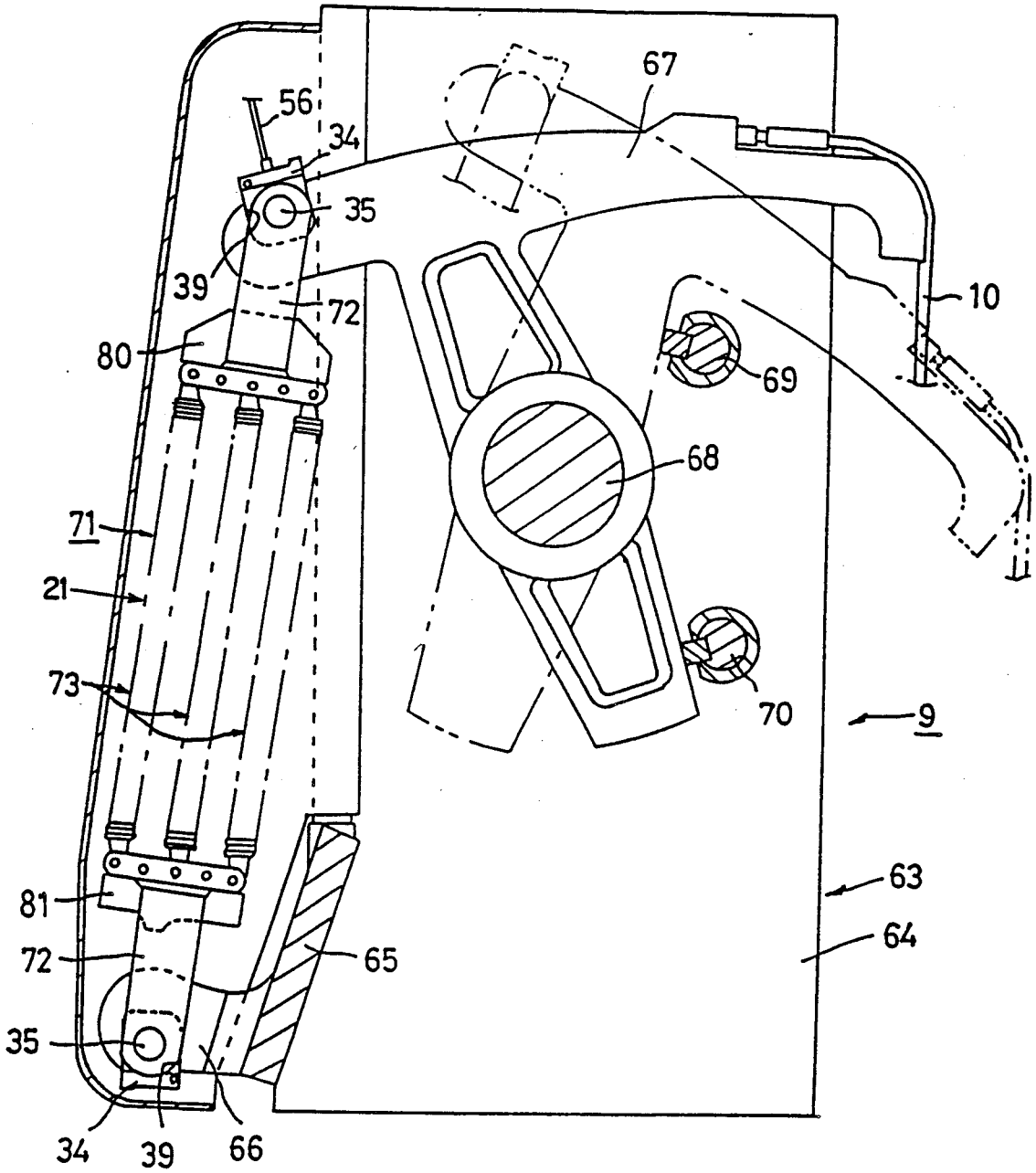
FIG. 20 is a front elevational view of the pulling means applied to the weaving machine illustrated in FIG. 19, and this pulling means includes the bearing means of the connector means according to a sixth preferred embodiment of the present invention.
Figure 21:
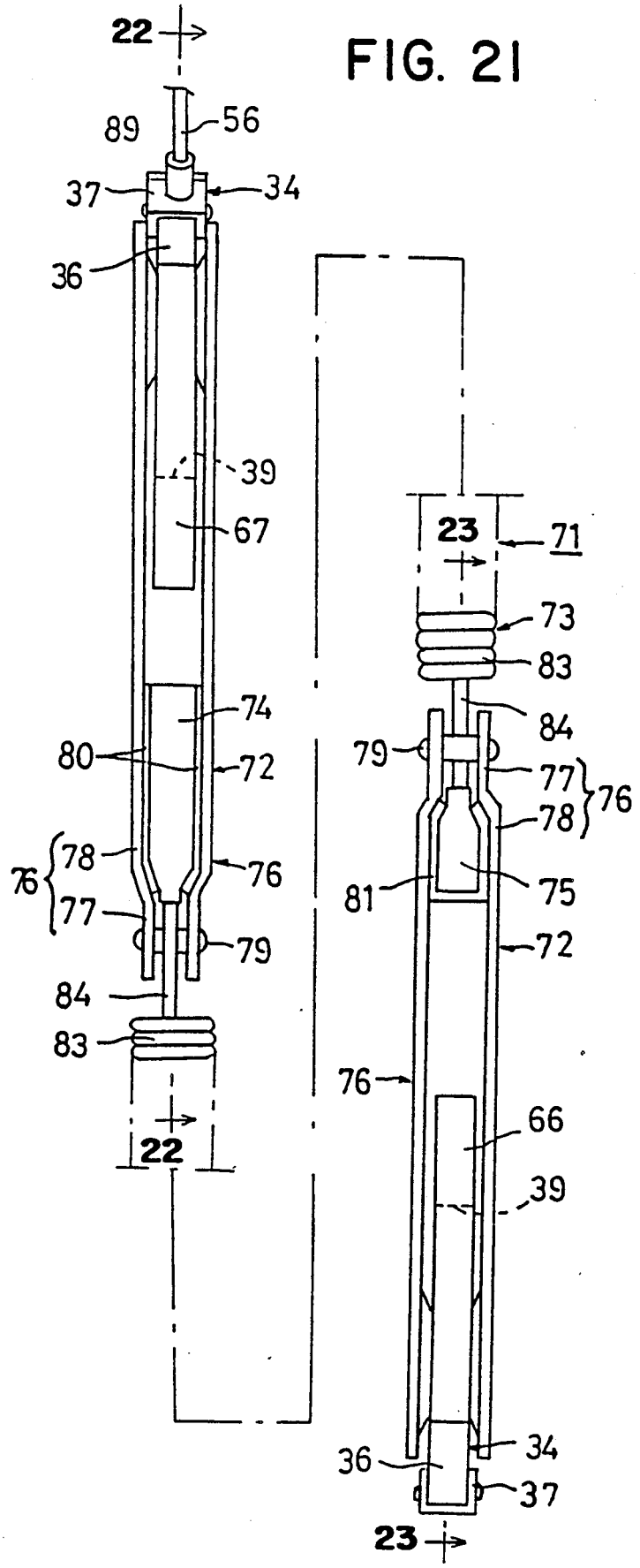
FIG. 21 is a cross-sectional view in the direction shown by the arrow head 21 in FIG. 20.
Figure 22:
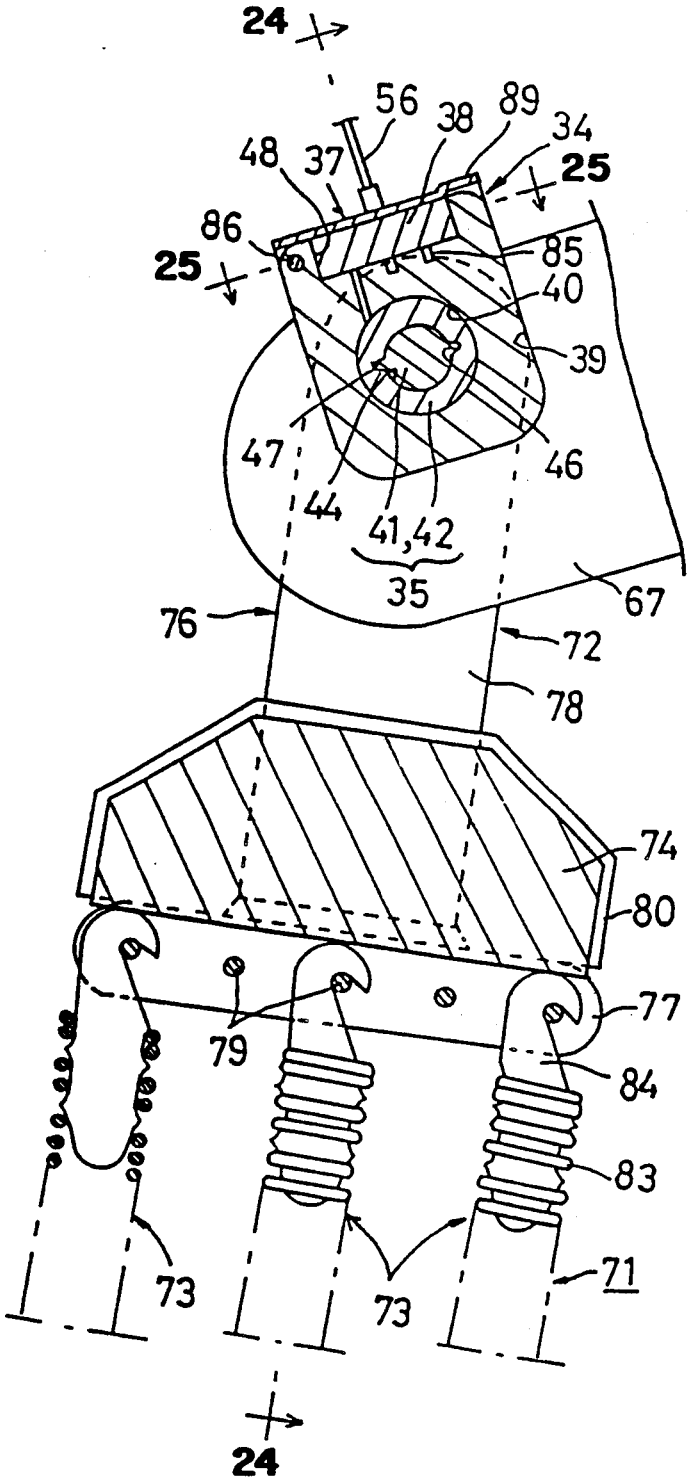

If the actuating device 5 is operated to lift a predetermined harness frame 2 so that an opening is made between the warp passing through the eye or male of the heddle of the harness frame and the other warp, the drawing lever 67 connected with the harness frame 2 through the wire 10 is rotated about the supporting shaft 68 to a position of the drawing lever as illustrated with an imaginary line in FIG. 20. On the other hand, if the actuating device 5 is released from the lifting action thereof upon the harness frame 2 in lifted condition, the drawing lever 67 is returned to the original rest position thereof by the spring force of the resilient member 73 of a traction mechanism 71 which corresponds to the lifted harness frame 2, and as a result, the harness frame 2 is smoothly relocated to the original rest position thereof.

In the foregoing operation, a lubricant which keeps infiltrated in the lubricant retaining member 38 inserted within the lubricant storing recess 48 of the upper bearing means 34 passes through the slender slot 50 to the mating surfaces of the inner circumferential surface of the shaft hole 40 of the bearing means 34 and the outer circumferential surface of the outer shaft element 42 of the supporting shaft means 35 to thereby achieve lubrication between said mating surfaces.

The lubricant applied to the mating surfaces of the inner circumferential surface of the shaft hole 40 of the bearing means 34 and the outer circumferential surface of the outer shaft element 42 of the supporting shaft means 35 flows downwardly through the Nylon body member 36 of the bearing means 34 and the inner surfaces of the side plates 76 of the bracket 72 to the upper side lubricant retaining member 74, and as a result, the infiltration of the lubricant into the retaining member 74 is carried out.

The lubricant infiltrated in the upper side lubricant retaining member 74 of the upper bearing means gradually reaches the contact surfaces of the upper side hook means 84 and the engaging pins 79 through the upper side hook means 84 to thereby lubricate said contact surfaces.

Subsequently, the lubricant flows downwardly to the mating surfaces of the lower side hook means 84 and the engaging pins 79 from the contact surfaces of the upper side hook means 84 and the engaging pins through the upper side hook means, the springs 83 and the lower side hook means 84 to lubricate said mating surfaces.

Moreover, the lubricant flows downwardly from the mating surfaces of the lower side hook means 84 and the engaging pins 79 to the lower side lubricant retaining member 75 through the lower side hook means 84. The lubricant is infiltrated in the lower side lubricant retaining member 75.

The lubricant infiltrated in the lower side lubricant retaining member 81 gradually drops onto the outward projection 66 of the connecting member 65 from the aperture 82 of the recess type lubricant storing member 81, and flows downwardly along the front and rear surfaces of the projection 66 to the outer shaft means element 42 of the supporint shaft 35, to thereby lubricate the mating surfaces of the outer shaft element 42 and the shaft hole 40 of the lower bearing means.

As is apparent from the foregoing description, the mating surfaces of the engaging pins 79 and the hook means 84 are satisfactorily lubricated by means of the lubricant infiltrated in the upper lubricant retaining member 74, while at the same time, sufficient lubrication between the inner circumferential surface of the shaft hole 40 of the lower bearing means 34 and the outer circumferential surface of the outer shaft element 42 of the supporting shaft 35 is achieved by means of the lubricant infiltrated in the lower lubricant retaining member 75.

The lubricant retaining members 74, 75 may also be directly fed with a lubricant.

Also, the lower bearing means 34 with the lubricant storing recess does not have to be provided, and in the lower bracket 72, the supporting portion 78 of both side plates 76 may be pivotally connected directly to the projection 66 of the connecting member 65.

The resilient members 73 may occasionally consist of the coil spring 83 only.

The connecting wires 7 may be any wiry bodies.

As fully described in the foregoing, the connector of the present invention includes at least one bearing means and a wire connecting mechanism as the principal components thereof.

The bearing means includes a shaft hole having a supporting shaft rotatably inserted therethrough, and is engaged with the holding portion of the shedding lever, and this engagement is such that the bearing means does not rotate with respect to the shedding lever. Moreover, the bearing means comprises a lubricant storing recess in the outer circumferential surface threof. The lubricant storing recess and the inside of the shaft hole are communicatively connected with each other by using a slender slot. This arrangement allows a lubricant to be gradually fed from the lubricant storing recess to the mating surfaces of the inner circumferential surface of the shaft hole and the outer circumferential surface of the shaft over a long period of time, and achieves satisfactory long-term lubrication between said mating surfaces.

In an alternative arrangement, the bearing means includes within the lubricant storing recess a lubricant retaining member to infiltrate a lubricant in this retaining member. Therefore, even if the bearing means is applied to a positive type wire connecting mechanism, and is unavoidably moved, a lubricant can be reserved within the lubricant storing recess over a long period of time, and sufficient long-term lubrication can be achieved between the inner circumferential surface of the shaft hole and the outer circumferential surface of the supporting shaft.

The wire connecting mechanism, the other principal component of the connector means according to the present invention comprises anchoring means, fixing bolts, wire jointing means, and rest means. The anchoring means is engaged with the wire jointing means, and the engagement of the anchoring means with the wire jointing means is held by means of the fixing bolts, while at the same time, the wire jointing means is fixedly pressed against the centrally located rest means. This arrangement removes any risk that the bracket portion having wires connected therewith undergoes early breakage thereof. Moreover, in this arrangement, the wires can easily be replaced with new ones, and when the wires are requried to be exchanged for a new one, it is not necessary to also replace the bracket itself with a new one.

The foregoing are advantages of the present invention which can not be obtained from any prior art arrangement, and the present invention is therefore greatly useful in practical use thereof. Moreover, it is to be understood that the present invention is not limited in the application therof to weaving machines. That is to say, the wire connecting mechanism of the present invention is widely applicable to many other machines or equipments, such as the oil-hydraulic systems of airplanes, the braking sytems of automobiles, motorcylces and bicycles, and the like in which wire type bodies are connected with their elements, and on the other hand, the bearing means of the present invention is also widely employed for any type of other machines or equipment in which the shaft and bearing systems are in use.

Although the present invention has been fully described by way of examples with reference to the accompanying drawings, it is to be noted here that various changes and modifications will be apparent to those skilled in the art. Therefore, unless such changes and modifications otherwise depart from the scope of the present invention, they should be construed as being included therein.

I claim:

1. A connector comprising:

a bracket having first and second ends, and said bracket including a pair of spaced opposed side plates;

connecting means at said first end of said bracket for connecting one of a wire and a first machine element to said bracket; and bearing means at said second end of said bracket for rotatably supporting said bracket, and a holding means for receiving said bearing means and fixing said bearing means to a second machine element, said bearing means including a synthetic resin body member with a shaft hole defined therein, a lubricant storing recess defined in an outer surface of said synthetic resin body member, a lubricant feeding guide defined in said synthetic resin body member and fluidly communicating said lubricant storing recess with said shaft hole for supplying lubricant from said lubricant storing recess to said shaft hole, and a supporting shaft member received in said shaft hole and attached to said bracket for rotatably connecting said bearing means and said bracket.

2. A device as in claim 1, wherein said connecting means includes three rest means secured between said pair of spaced opposed side plates, said three rest means being spaced apart at predetermined intervals, an anchoring means pivotably attached to each one of said pair of spaced opposed side plates, and a fixing bolt detachably screwed through each one of said anchoring means and through each said one of the outer ones of said three rest means.

3. A device as in claim 1, wherein said connecting means includes three rest means secured between said pair of spaced opposed side plates, said three rest means being spaced apart at predetermined intervals, wire jointing members received between adjacent ones of said three rest means, anchoring means pivotably attached to each one of said pair of spaced apart side plates for detachably engaging the wire jointing member received between an outer one of said three rest means nearest to the said one of said pair of spaced opposed side plates and the middle one of said three rest means, and a fixing bolt detachably screwed through each one of said anchoring means and through each said one of the outer ones of said three rest means, said fixing bolt causing said anchoring means to engage the outer one of said three rest means engaging the wire jointing members received between the outer and the middle rest means, said fixing bolt restraining movement of the outer one of said three rest means for keeping said anchoring means engaged with a said wire jointing member, and said fixing bolt engaging the middle one of said three rest means via a said wire jointing member received adjacent thereto for preventing movement thereof.

* * * * *